US005801322A

United States Patent [19]

Laine et al.

[11] Patent Number: 5,801,322

[45] Date of Patent: Sep. 1, 1998

[54] EXERCISE MINE AND PROGRAMMING AND SIMULATION DEVICE THEREFOR

[75] Inventors: Loïc Laine, Saint Doulchard; Philippe Arnaud, Orléans, both of France

[73] Assignee: Giat Industries, Versailles, France

[21] Appl. No.: 714,052

[22] PCT Filed: Jan. 31, 1996

[86] PCT No.: PCT/FR96/00165

§ 371 Date: Sep. 9, 1996

§ 102(e) Date: Sep. 9, 1996

[87] PCT Pub. No.: WO96/24818

PCT Pub. Date: Aug. 15, 1996

[30] Foreign Application Priority Data

Feb. 10, 1995 [FR] France ..... 95 01580

[51] Int. Cl.[6] ..... G01V 3/165; F42B 8/28

[52] U.S. Cl. ..... 102/401; 102/407; 434/11; 89/1.13; 324/327

[58] Field of Search ..... 434/11; 102/401, 102/402, 403, 407, 416, 424, 427; 89/1.1, 1.11, 1.13; 324/327

[56] References Cited

U.S. PATENT DOCUMENTS

| | | | |
|---|---|---|---|
| 2,896,204 | 7/1959 | Gille . | |
| 3,707,913 | 1/1973 | Lee | 102/402 |
| 3,939,770 | 2/1976 | Amundson et al. | 102/427 |
| 4,190,000 | 2/1980 | Shaull et al. | 102/427 |
| 5,027,709 | 7/1991 | Slagle . | |
| 5,074,793 | 12/1991 | Hambric et al. | 434/11 |
| 5,113,766 | 5/1992 | Grosch | 102/427 |
| 5,292,254 | 3/1994 | Miller et al. | 434/11 |
| 5,415,103 | 5/1995 | Radermacher | 102/427 |
| 5,458,063 | 10/1995 | Laine et al. | 102/402 |
| 5,719,501 | 2/1998 | Spektor et al. | 324/345 |

FOREIGN PATENT DOCUMENTS

| | | | |
|---|---|---|---|
| A2-0 324 564 | 7/1989 | European Pat. Off. . | |
| 574967 | 12/1993 | European Pat. Off. | 89/1.13 |
| A1-0 593 131 | 4/1994 | European Pat. Off. . | |
| A-2 105 952 | 3/1983 | United Kingdom . | |
| WO 91/04503 | 4/1991 | WIPO . | |
| WO 93/06504 | 4/1993 | WIPO . | |

OTHER PUBLICATIONS

29th IEEE Vehicular Technology Conference, Mar. 27–30, 1979, The Institute of Electrical and Electronics Engineers Inc., New York USA XP002003345, "Microwave Automatic Vehicle Identification (AVI) System", J. Sakuragi et al., pp. 72–78.

Excerpt from *IEEE Standard Dictionary of Electrical and Electronics Terms*, p. 606, "oscillatory circuit.", 1984.

*Primary Examiner*—Charles T. Jordan
*Assistant Examiner*—Christopher K. Montgomery
*Attorney, Agent, or Firm*—Oliff & Berridge, PLC

[57] ABSTRACT

The invention relates to an exercise mine system for training in mine detection. The invention including a passive oscillating circuit tuned to a certain frequency. This circuit being designed to be detected by another active oscillating circuit carried by an individual or vehicle.

23 Claims, 9 Drawing Sheets

EXERCISE MINE AND PROGRAMMING AND SIMULATION DEVICE THEREFOR

BACKGROUND OF THE INVENTION

The technical scope of the present invention is that of exercise mines and devices enabling the simulation of the action of a mine.

Simulation devices are known which implement complicated means to materialize the action of a mine on a vehicle or person.

Therefore, more often than not, the mine is not present on the ground, but occupies a theoretical assigned position by a check point which is radio linked to receivers carried on the vehicles and/or persons.

The position of the latter is known by means such as global positioning systems (commonly termed GPS) or inertial navigation plates. The check point compares the actual position of the vehicles and individuals with that of the mines and sends them a signal when one of them triggers a mine.

Such devices are complicated to implement. They necessitate the use of positioning means which may not be accurate enough and involve onerous computation means. In practice, they can only be implemented on specially prepared areas of land which are equipped with suitable infrastructures.

These devices are also incomplete since they do not allow the actual positioning of a mine field to be simulated.

Exercise mines are known elsewhere which comprise inoffensive pyrotechnic charges (smoke-generating, noise-generating) which are triggered by the approach of a vehicle or person. The advantage of such mines is that they enable the realistic simulation of the activation of a real mine. However, they are expensive as they involve the use of a pyrotechnic charge and detection means for a real mine.

Moreover, although their effect is theoretically danger-free, such mines can not be left in the ground undetonated. Their use therefore necessitates a long and costly operation to demine the area of land after the training exercise.

SUMMARY OF THE INVENTION

The aim of the invention is to solve the above problems by proposing, on the one hand, an inert exercise mine at a low cost but which enables the realistic simulation of the effect of a real mine, and on the other, a device to simulate the action of the mine and which implements such an exercise mine.

The invention also proposes a device to program such an exercise mine which enables a given exercise mine to be given different detection characteristics.

The invention lastly proposes a device to simulate a demining operation, a device which also implements an exercise mine according to the invention.

According to the invention, an exercise mine it comprises at least one passive oscillating circuit tuned to a certain frequency, and a circuit designed to be detected by at least one active oscillating circuit carried by a person or by a vehicle.

The passive oscillating circuit will comprise at least one fuse or destructible part.

The passive oscillating circuit can comprise at least one inductive resistor whose terminals are connected to at least two circuit arms, each arm being formed of a capacitance and a fuse or destructible part connected in series.

The passive oscillating circuit can be made in the form of a rigid printed circuit attached to the mine. It can also be made in the form of a flexible printed circuit fastened to the mine. The passive oscillating circuit is formed of a serigraph of conductive paint.

This serigraph can be carried on a label stuck onto the mine.

A further subject of the invention is a device to program such a mine. Such a device it comprises an active oscillating circuit which generates a signal at an adjustable frequency and strength, an active circuit enabling the determination of the oscillation frequency of the passive circuit carried by the mine, and includes a switch controlling the generation of a power signal at this oscillation frequency, the signal designed to melt a fuse integral with the passive oscillating circuit of the mine.

The invention also relates to a device to simulate the action of a mine, the device it comprises means to detect at least one passive oscillating circuit carried by an exercise mine, the means including at least one active oscillating circuit.

According to a particular embodiment, the detection means comprises at least a receiver coil connected with amplifying means and a band filter.

According to another embodiment, the detection means comprise at least two active oscillating circuits, each circuit being tuned or able to be tuned to its own different frequency, thus enabling the detection and differentiation of at least two passive circuits carried by two different exercise mines.

According to another embodiment, the active oscillating circuit is designed so as to be able to deliver a signal at a wobbled frequency in a given frequency band so as to enable the detection of at least two passive circuits carried by two different exercise mines.

According to another embodiment, the active oscillating circuit or the filter is connected to a fluctuation detector whose sensitivity threshold is determined so as to detect a position of this active oscillating circuit at a given distance from a passive oscillating circuit integral with a mine.

Advantageously, the fluctuation detector controls a signalling means.

The fluctuation detector can also control the emission of a power signal by the active oscillating circuit, the signal designed to melt the fuse or fuses integral with the passive oscillating circuit carried by the mine.

The signalling means can comprise circuit breaking means positioned in a power supply circuit of the vehicle, the fluctuation detector activating the means so as to make the vehicle stop.

According to another embodiment of the invention, the simulation device comprises a monitor device for at least the active-life time of an exercise mine, a device which comprises a timer and at least one memory or recorder designed to receive at least a number representative of an active-life time. This monitor device controls a circuit breaker means so as to prevent the activation of the signalling means by the fluctuation detector when the active-life time attributed to this mine is over.

According to an alternative, the simulation device comprises a monitor device for at least two active-life times of an exercise mine. The simulation device comprising means to determine the tuning frequency of a detected passive circuit and to associate this frequency to one of the active-life times memorized so as to prevent the activation of signalling means by the fluctuation detector when the active-life time associated with the detected mine is over.

Advantageously, when the simulation device is fitted to a vehicle, the active oscillating circuit comprises a coil attached to a front part of the vehicle, insulated from the latter by a screen of material having high magnetic permeability and high specific resistance.

A further subject of the invention is a device to simulate a demining operation which comprises a signal generator at a pre-determined frequency, this signal being of a strength chosen so as to melt the fuse or fuses integral with a passive oscillating circuit carried by an exercise mine according to the invention.

BRIEF DESCRIPTION OF THE DRAWINGS

The invention will be better understood after reading he description of the particular embodiments, with reference to the appended drawings, in which.

DETAILED DESCRIPTION OF THE PREFERRED EMBODIMENTS

Figure 1:
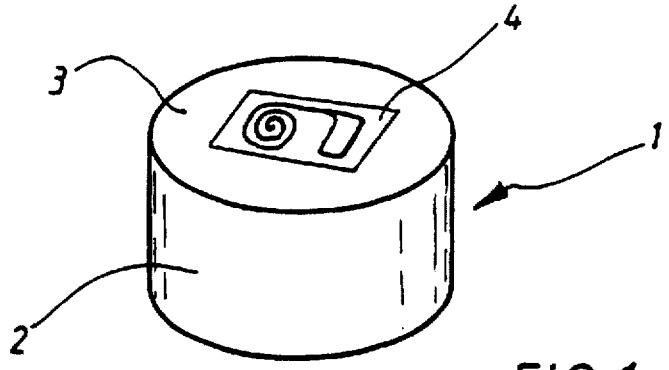
FIG. 1 shows a mine according to a particular embodiment of the invention.

With reference to FIG. 1, an inert exercise mine 1 according to the invention has a roughly cylindrical body 2. The exercise mine 1 is of a shape similar to that of a war mine, so that it can be laid realistically.

Laying can be carried out manually or by means of a scatterer or burier. A scatterer constituted by a carrier shell or rocket, or a scatterer comprising launcher tubes mounted onto a vehicle can be used.

So as to reduce pollution of the training areas, the mine will preferably be formed of a block of biodegradable material, for example pressed and dried peat or cement which breaks up in humidity.

One face 3 of the mine carries a label 4 attached by bonding.

Figure 2A:
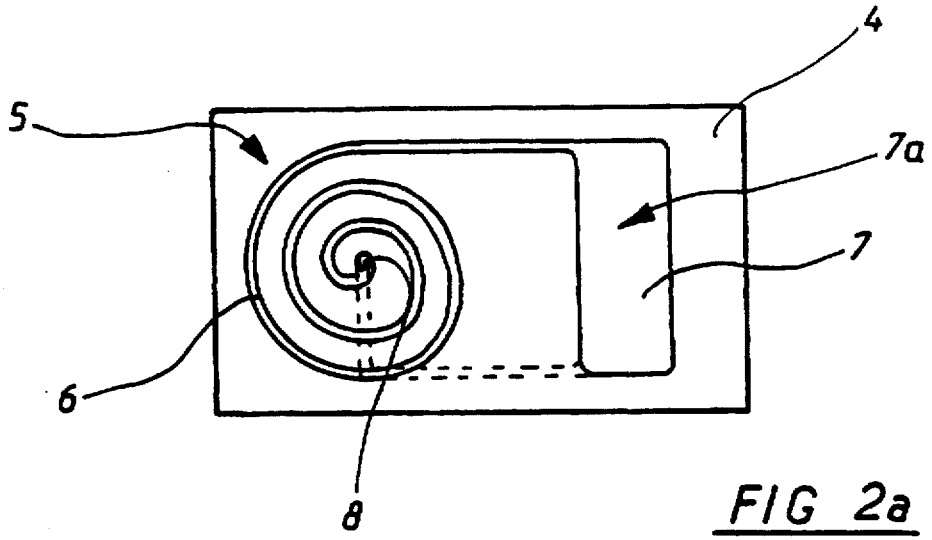
FIGS. 2*a* and 2*b* show front and back views of the label carried by the mine in FIG. 1.
Figure 2B:
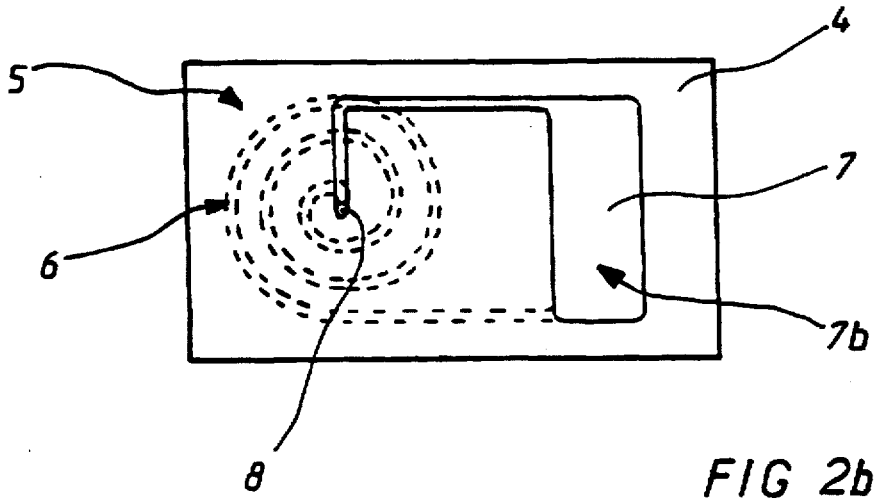

The label 4 can be seen in detail on FIGS. 2*a* and 2*b*. It is made of a flexible plastic material, for example Nylon (or even paper), and carries on each face a deposit of conductive ink (for example, graphite-based ink). The deposit will preferably be made by serigraphy. Together the conductive ink deposits form an oscillating electric circuit 5 comprising an inductive resistor 6 whose terminals are connected to a capacitance 7.

One armament 7*a* of the capacitance is carried by one face of the label 4, the other armament 7*b* is carried by the other face of the label. The constitutive material of the label forms the dielectric of this capacitance.

The inductive resistor 6 is carried by a single face of the label 4 and it is formed of a spiral-shaped strip conductor. The armament 7*b* of the capacitance is connected to the inductive resistor 6 by a connection 8 which passes through the label.

The connection can, for example, be made by providing a hole through the label which is filled by a conductive material after serigraphy. The hole can also be metallized.

The oscillating circuit 5 is totally passive. No power source is provided thereby making the mine extremely simple and inexpensive. Capacitance and inductance values will be chosen such that this circuit is tuned to a given frequency depending on the characteristics of an active oscillating circuit carried by a person or a vehicle.

It is easy to vary the capacitance by acting on the surface of the armaments 7*a*, 7*b* and to vary the inductance by changing the length and maximum diameter of the spiral.

It is thus possible to choose different characteristics for a mine designed to simulate an anti-tank mine or for a mine simulating an anti-personnel mine.

Figure 3A:
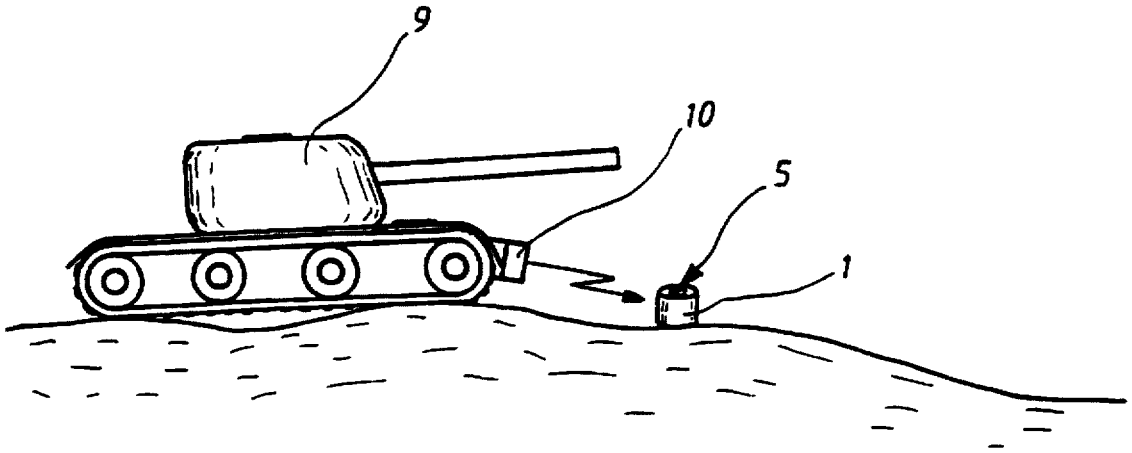
FIGS. 3*a* and 3*b* show the implementation by a vehicle of the simulation device according to the invention and FIG. 3C shows the use of the simulation device in an anti-personnel mode.
Figure 3B:
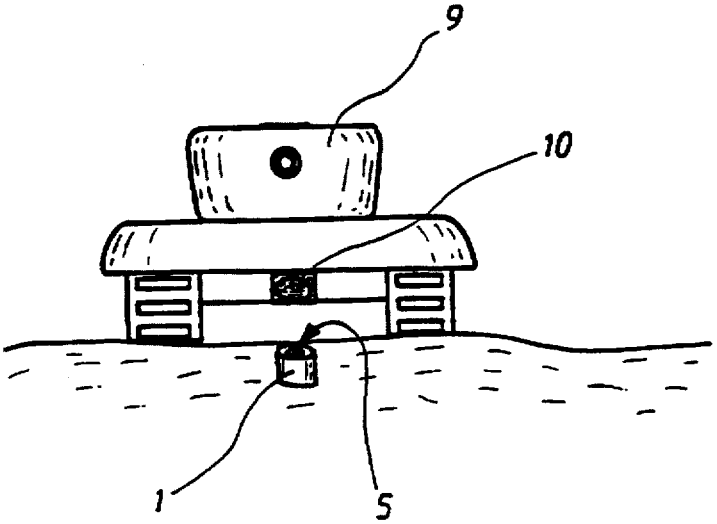

FIGS. 3*a* and 3*b* show a vehicle 9 (in this example, a tank) which carries a case 10 on its front part which forms part of a simulation device according to the invention.

The case 10 is positioned in a roughly median position between the vehicle tracks (see FIG. 3*b*).

The case contains an active oscillating circuit which is positioned so as to emit an electromagnetic field towards the front of the vehicle 9.

Figure 3C:
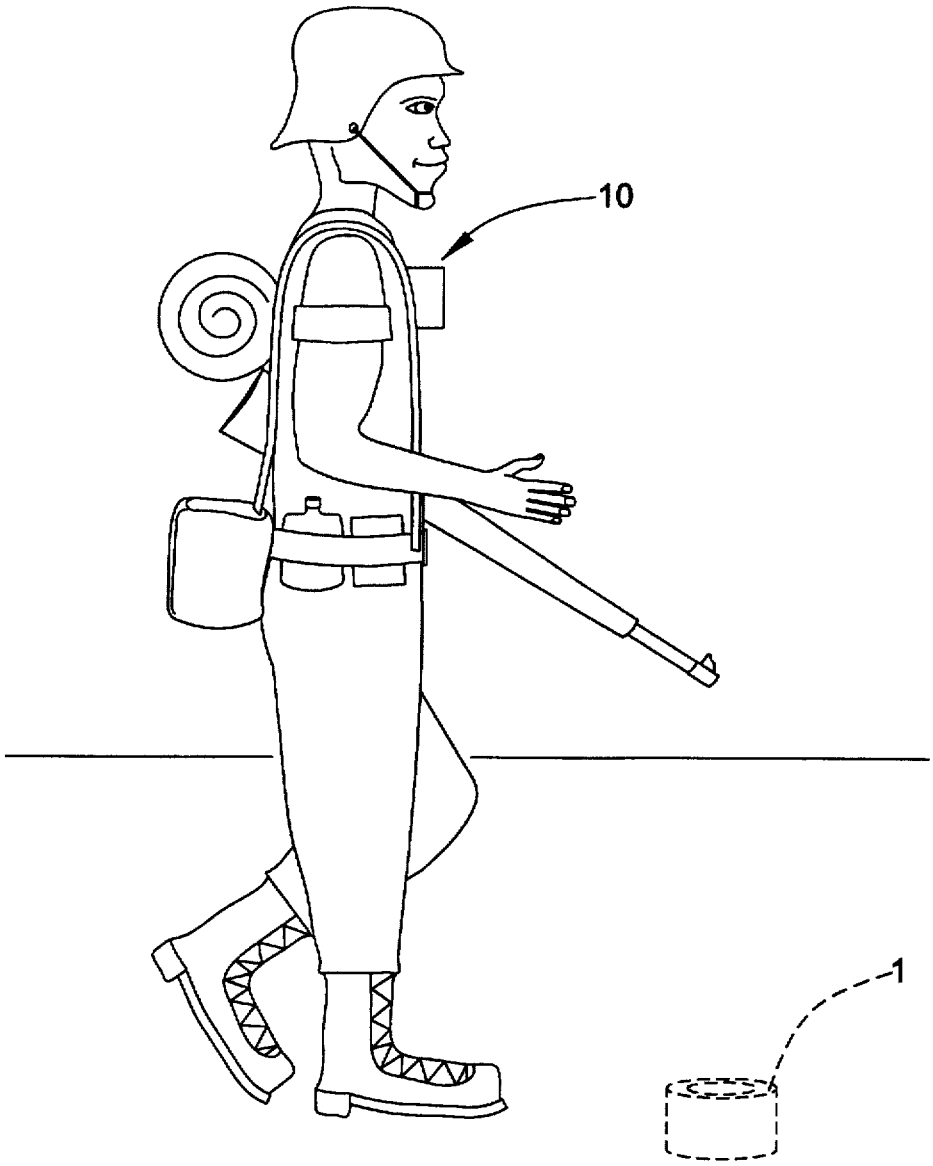

FIG. 3*c* shows the simulation device where the exercise mine 1 simulates an anti-personnel mine and the case 10, with the active oscillation circuit, is carried on a soldier's web gear.

The active oscillating circuit is designed to act as the detector for the passive oscillating circuit 5 carried by the exercise mine 1.

Figure 4:
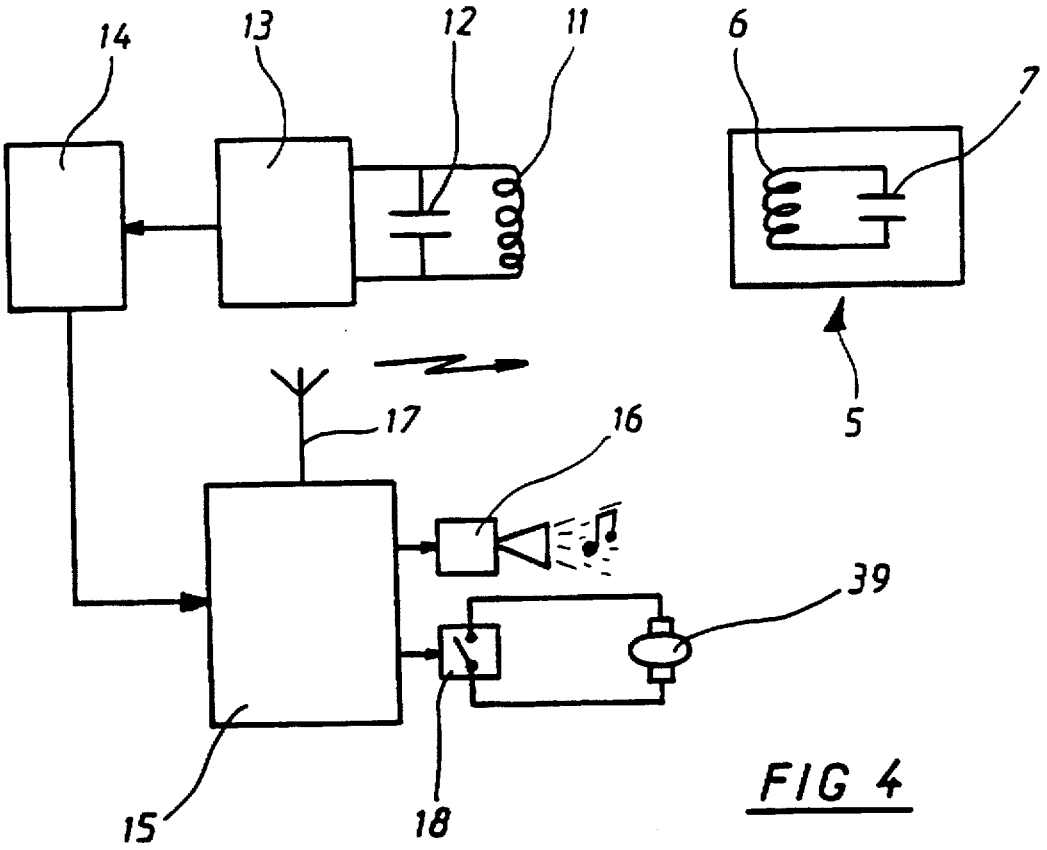
FIG. 4 is a schematic electrical diagram of the simulation device according to a first embodiment of the invention.

FIG. 4 shows a schematic electrical diagram of the simulation device according to the invention.

The case 10 contains detection means which comprise. an active oscillating circuit comprising an inductive resistor 11, a capacitance 12, and a generator 13. The oscillating circuit being connected to a fluctuation detector 14. The active circuit is tuned to a frequency which is the same as that of the passive oscillating circuit 5 carried by the mine 1.

When the detector case reaches the vicinity of the mine 1, the oscillating circuit 11, 12, 13 is unbalanced because of the coupling which is made between the active oscillating circuit 11, 12, 13 and the passive circuit 5. This is manifested, for example, by a fluctuation in its frequency, its amplitude or its consumption according to the circuitry retained (such circuitries are conventional and are well known to one having skill in the art.

The fluctuation detector 14 of a known type (for example, a synchronous detector) has a sensitivity threshold determined so as to be able to pick out the approach of an active oscillating circuit 11, 12, 13 at a given distance from the passive oscillating circuit 5. This distance will be chosen as being that which corresponds to the triggering of a real mine by the vehicle.

The fluctuation detector is connected to a control means 15 which will automatically trigger one or several signalling means according to the requirements of the user, for example:

a) the triggering of a siren 16, b) the confirmation (antenna 17) by radio transmission to the training operation control center that the vehicle is out of action, c) the breaking of circuits 18 (electric and/or hydraulic) positioned in a power supply circuit of the vehicle, thereby causing its engine 39 to stall and immobilizing the vehicle in the training area.

The control means will comprise, for example, a microprocessor which will trigger the signalling means (via static relays) according to the program given by the user. It can also comprise a GPS receiver able to calculate the coordinates of the carrier when it encounters the mine, and radio transmission means to send these coordinates and also able to send information related to the type of mine encountered (for example, the frequency value of the passive circuit, and/or memorized code associated with this frequency). The control means can also naturally be made using conventional means, for example, electromechanical relays controlled by a cabled logic circuit.

It is possible to accurately adjust the activation distance by acting, firstly on the sensitivity of the fluctuation detector 14 and secondly on the power of the generator 13.

The case 10 can naturally contain only part of the active oscillating circuit 11, 12, 13 and more often than not it will contain the inductive resistor 11.

In concrete terms, this inductive resistor 11 will be made in the shape of a coil and this coil will be insulated from the magnetic mass of the vehicle by means of a screen made of a material having a high magnetic permeability (greater than or equal to 1000 μr) and high specific resistance (greater than $10^{31\ 6}$ Ω·m). This screen will, for example, be placed at the bottom of the case 10 and can be made of magnetically permeable metal.

Such an arrangement reduces the influence of the carrier on the active oscillating circuit 11, 12, 13.

By way of illustration, a passive circuit 5 tuned to a frequency at between 100 kHz and 10 MHz may be made. The active circuit carried by the vehicle will function at the same frequency and will be of a power at less than 5 W (for example), which enables the passive circuit to be detected at a distance of around 500 mm between the coil and the mine. The sensitivity threshold can thereafter be adjusted so that the mine is only detected when it lies under the vehicle and this whatever the position of the mine with respect to the ground.

It may thus be seen that the invention enables a very realistic simulation of the functioning of a mine. This simulation is all the more realistic in that the control means can cause the vehicle to stop, putting it out of action.

The transmission by radio of the state of the vehicle allows the exercise to be monitored from a distance. None of the means implemented requires complicated calculation means. The vehicle can be fitted with navigation means coupled with radio transmission means, this in order to send back to the exercise control center the coordinates of the immobilized vehicle.

The invention has been described above in its anti-vehicle mine simulation capacity. It is also possible to define an anti-personnel exercise mine which is fitted with a passive oscillating circuit according to the invention. An operational frequency will be selected, in this case, which is different from that or those associated with the anti-vehicle mines.

Each individual taking part in the exercise will be given an appropriate individual detector, similar to that described above, of which the frequency and the range will be selected to as to detect the anti-personnel mine and simulate its triggering (for example, by means of an alarm carried by the individual, possibly coupled with a coloring pellet to mark his clothes).

With the invention, it is no longer necessary to know the precise location of the different mines in order to conduct the exercise in a realistic manner. It is therefore possible to scatter these mines by any known operational means (shell, rocket, launcher).

It may also be noted that, by selecting the operating frequencies appropriately, an anti-vehicle mine will not be detected by an individual thereby making the exercise even more realistic.

The mines used are totally inert, therefore leaving them in the ground presents no risk whatsoever to the civil population or to animals. Furthermore, the mines can be made of a biodegradable material thereby facilitating their automatic elimination. The passive oscillating circuit is non-toxic and of a small size, it is nonpolluting. It is possible, in fact, to produce the circuit on a biodegradable label (paper, for example).

Figure 5:
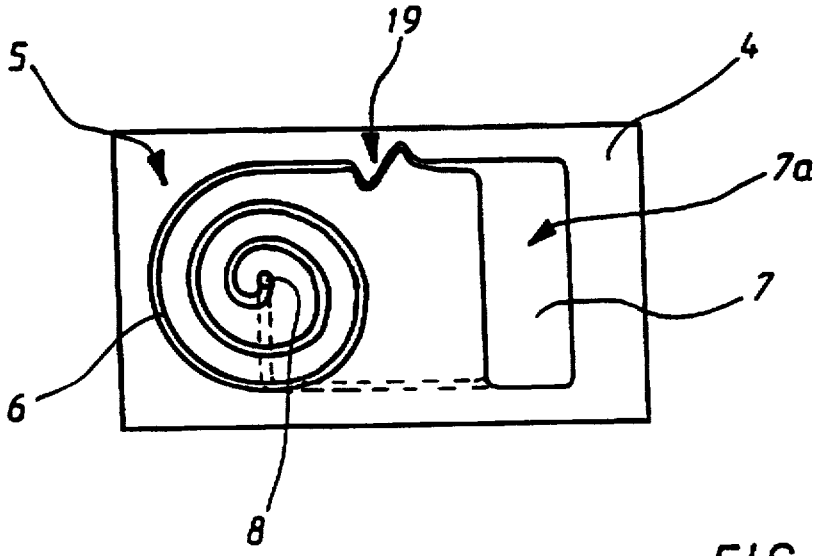
FIG. 5 shows an alternative embodiment of the passive oscillating circuit.

FIG. 5 shows an alternative embodiment of the passive oscillating circuit 5 shown here as a serigraphy carried on a label 4.

The circuit according to this embodiment comprises a fuse 19 made by thinning the serigraphed conducting strip.

According to this alternative embodiment, when the passive circuit is detected by the fluctuation detector 14, means are provided (for example, a power switch) which controls the generator 13 such that the latter sends a strong enough signal for the current induced in the passive circuit 5 to melt the fuse 19.

The advantage of such an alternative is to make the passive circuit 5 inactive afterwards. The exercise is thereby made more realistic, a mine only being able to be detected once.

Various alternatives are possible without departing from the scope of the invention.

Thus, the passive oscillating circuit carried by the mine can be made in the form of a rigid printed circuit attached to the mine, or positioned inside it.

This circuit can comprise conventional electronic components (capacitances, resistors, inductive resistors, fuses) welded to the tracks of the printed circuit.

The passive oscillating circuit can also be made in the form of a flexible or relatively flexible printed circuit attached to the mine, for example, a glass/epoxy circuit or a circuit having metallic strips integral with a plastic material.

Figure 6:
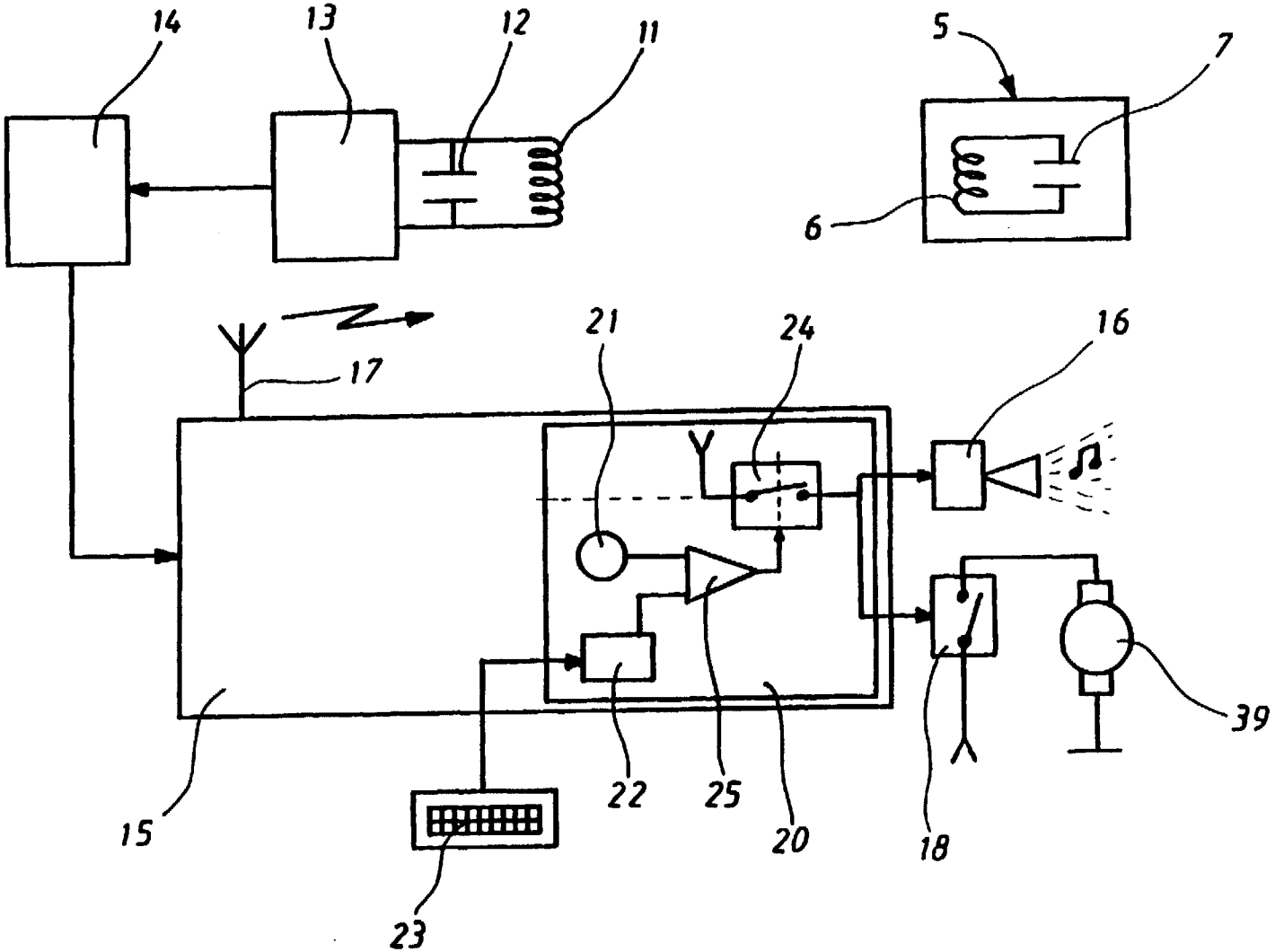
FIG. 6 is a schematic electrical diagram of the simulation device according to a second embodiment of the invention.

FIG. 6 shows a simplified electric diagram of a simulation device according to a second embodiment of the invention.

This embodiment differs from the preceding one in that the control means 15 comprises an active-life time monitor device 20.

This device comprises a memory 22, inside which a certain active-life time is recorded (for example, by means of a keyboard 23) for the exercise mines.

It also comprises a timer 21, a comparator 25 and a static relay 24.

This alternative embodiment functions as follows :

Before the exercise commences, the active-life time of the exercise mines used is recorded into the memory 22. The timer is set at the beginning of the exercise so that time-0 corresponds to the time the mines are supposed to be positioned.

The static relay 24 is in a normally closed position. Thus, when a mine is detected by the fluctuation detector 14, the signalling means are activated as above.

When the time indicated on the timer 21 equals that recorded in the memory 22, the comparator 25 causes the static relay 24 to open.

After opening, the signalling means are no longer activated when the vehicle (or individual) encounters an exercise mine.

Such an alternative enables the exercise to be made even more realistic.

In concrete terms, the active-life time monitor device 20 is made by using a microprocessor which manages the operation of the control means 15.

Figure 7:
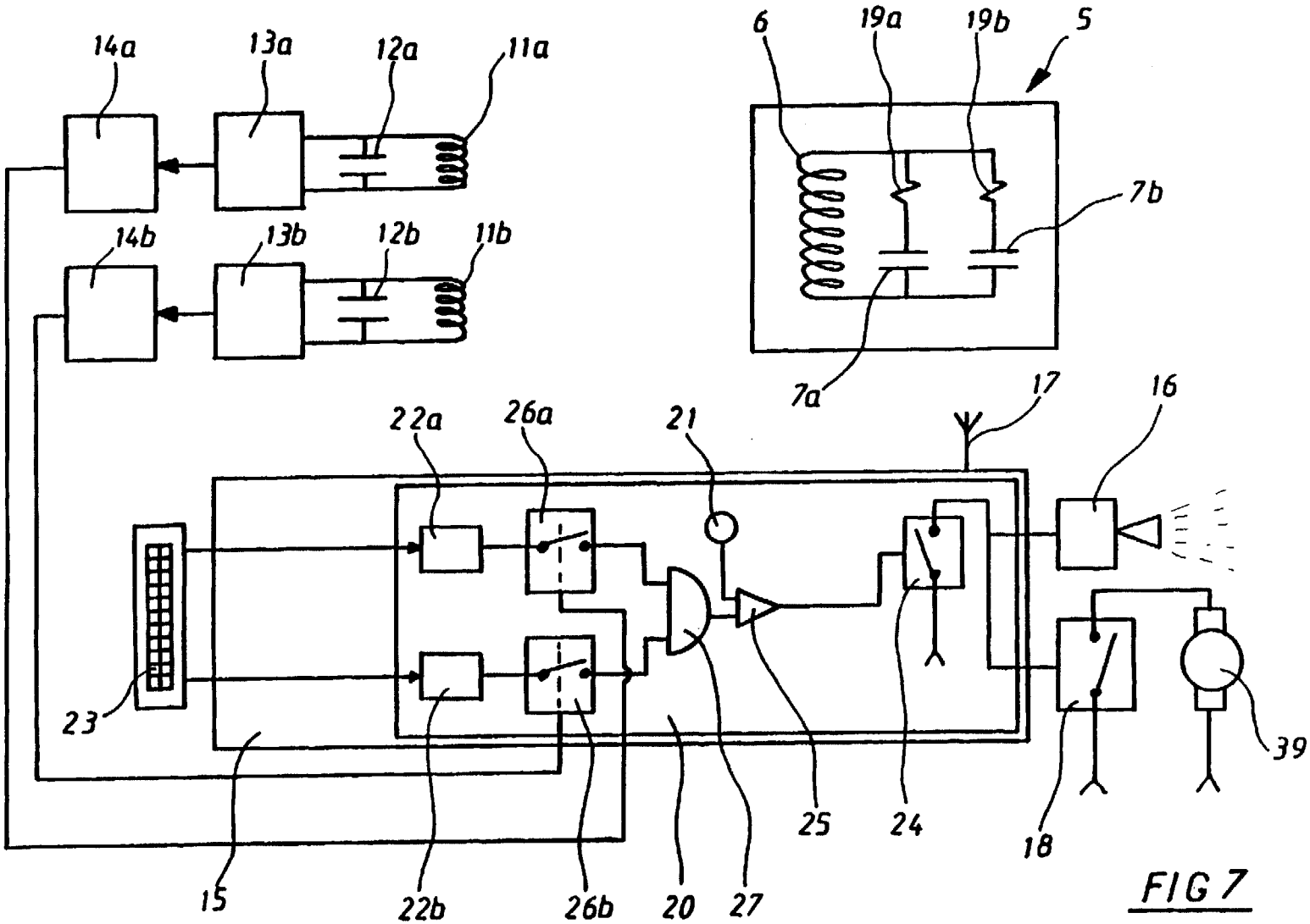
FIG. 7 is a schematic electrical diagram of the simulation device according to a third embodiment of the invention.

FIG. 7 shows a simplified electric diagram of a simulation device according to a third embodiment of the invention.

The detection means contained in this device comprises two generators 13*a* and 13*b*, each supplying a different active oscillating circuit formed of an inductive resistor (11*a*, 11*b*) and a capacitance (12*a*, 12*b*). Each active circuit is tuned to a different frequency.

This simulation device is implemented with exercise mines having a passive oscillating circuit 5 of the type which is shown in diagram form in FIG. 7. This oscillating circuit comprises an inductive resistor 6 whose terminals are connected to two circuit arms, each arm being formed of a capacitance (7*a*, 7*b*) and a fuse (19*a*, 19*b*) connected in series.

This passive oscillating circuit is shown here in a first state in which no fuse has been destroyed. It has, in this case, its self-resonant frequency Fr equal to $Fr_1=(2\pi L(Ca+Cb))^{-1}$.

The active oscillating circuit (11*a*, 12*a*, 13*a*) will be selected such that it is tuned of the resonant frequency $Fr_1$.

With such a passive oscillating circuit 5, the fluctuations in flow is subject to the self-inducting coil, induces a current I which runs through each arm proportionally to the capacitance Ca or Cb of the arm. The capacitance having the highest value (for example Ca) will have the strongest current flowing through it. If the circuit is subjected to an intense frequency field $Fr_1$, a current I1 can be caused, which would melt the fuse 19*a* located in this arm.

The passive oscillating circuit 5 is thereby modified and has a new resonant frequency $Fr_2=(2\pi LCb)^{-1}$.

The active oscillating circuit (11*b*, 12*b*, 13*b*) will be selected such that it is tuned to this resonant frequency $Fr_2$.

This makes it possible to recognise two different types of mine. The active oscillating circuits (11*a*, 12*a*, 13*a*) and (11*b*, 12*b*, 13*b*) both emit constantly. When one or the other is unbalanced because of its coupling with a passive circuit 5, this unbalance is detected by the associated fluctuation detector 14*a* or 14*b*.

In the example shown in FIG. 7, the circuit 11*a*, 12*a*, 13*a* tuned to frequency $FR_1$ detects the proximity of the passive circuit 5 carrying its two fuses.

Once the fuse 19*a* has been destroyed, circuit 11*b*, 12*b*, 13*b* tuned to frequency $FR_2$ detects the proximity of the passive circuit 5.

The fluctuation detectors 14*a* and 14*b* are connected to a control means 15, which, in this embodiment, comprises an active-life time monitor device 20.

This device comprises a timer 21 and two memories or recorders 22*a*, 22*b*.

Each memory is designed to receive a number representative of a theoretical active-life time for the exercise mine used.

The memory 22*a* will receive an active-life time associated to an exercise mine whose passive circuit has a resonant frequency of $FR_1$, and memory 22*b* will receive an active-life time associated with a mine whose passive circuit has a resonant frequency of $FR_2$.

The memories are programmed by means of a keyboard 23 or connection in series.

Circuit breaking means (for example, static relays 26*a*, 26b) are placed between each memory 22*a*, 22*b* and the signalling means (16, 18). Each means is in a normally open state. They are activated by the associated fluctuation detector 14*a*, 14*b*. The detection of an exercise mine of a certain type trips the relay 26*a*, 26*b* associated with this type of mine.

An inclusive or gate 27 groups the memory 22*a* and 22*b* outputs downstream of the static relays 26*a*, 26*b*. The output of this gate gives the contents of memory 22*a* or 22*b* which corresponds to the mine detected by the active oscillating circuits. This content is compared (at comparator 25) to the time value supplied by the timer 21.

The static relay 24 will here be in a normally open state. When the active-life time of the detected mine (T1 or T2) has not yet run out, the static relay 24 closes thereby activating the signalling means 16, 18.

When the active-life time of the mine has run out, because the relay 24 is normally open, the signalling means are not activated.

As an alternative, it is, of course, possible to provide a static relay 24 which is normally in a closed state. In this case, the comparator 25 will be mounted in such a way that when the active-life time of the mine has run out, the relay opens and the signalling means are not activated.

In this case, a delay device will be provided to close the static relay 24, to allow the vehicle to move away from the mine under consideration so as to enable it to take another mine into account whose active-life time has not yet run out. Such a delay device can be replaced by the detection of the removal of the oscillating circuit previously detected (return to the initial state of the active oscillating circuit).

In concrete terms, the active-life time monitor device 20 will be made by means of the microprocessor which manages the operation of the control means 15.

The control means can transmit, for the above embodiment, by means of the antenna 17 the parameters related to the mine detected, for example, the coordinates of the carrier upon encountering the mine, and the type of mine encountered (frequency of passive circuit or code associated with this frequency). This transmission can be commanded, whether the active-life time of the mine has run out or not. The information related to the type of mine can, for example, be taken from the inclusive or gate 27 output.

This embodiment of the invention has been described with a passive circuit comprising two capacitance/fuse arms connected to the terminals of the inductive resistor and with a simulation device formed of two active oscillating circuits. It is, of course, possible to design a passive circuit, carried by a label stuck on the mine, and having several capacitance/fuse arms. Such a passive circuit can have as many different resonant frequencies as it has arms having a capacitance. One of these frequencies will be selected by melting a certain number of fuses.

In practical terms, to carry out such an operation, a programming device is used which comprises an active oscillating circuit (similar to that used on the vehicle) but in which it is possible to vary the frequency and the amplitude of the signal emitted. This active circuit, first of all, allows the oscillation frequency of the passive circuit to be determined. Once the circuit has been tuned to this frequency, the operator activates a switch which controls the generation of a power signal at this oscillation frequency. As described above, this signal melts the fuse which is in the arm having the capacitance with the maximum value, thus modifying the self-resonant frequency of the passive circuit.

The operations of resonant frequency search and power signal generation are repeated as often as required to melt different fuses in the passive circuit and to give it the required self-resonant frequency.

As an alternative, the passive circuit can be programmed by mechanically breaking the arms which have to be excluded from the passive resonant circuit.

By way of illustration, it is possible to make a passive circuit comprising an inductive resistor L=5 μH and three capacitances Ca=10 nF, Cb=5 nF and Cc=1 nF. Such a circuit can have three resonant frequencies: $FR_1$=563 kHz (if all three capacitances are active), $Fr_2$=919 kHz (if only capacitances Cb and Cc are active) and $Fr_3$=2250 kHz (if only Cc is active). These three frequencies are far enough apart from each other to allow the easy differentiation of three different types of mine.

The simulation device carried by the vehicle (or by the individual) will comprise, in this case, three active circuits tuned to these three possible frequencies.

FIG. 7 described an embodiment in which the mines could have different active-life times, each time being associated with a different frequency of the passive circuit.

It is possible to design another embodiment in which a different type of mine instead of a different active-life time is associated with each possible frequency of the passive circuit.

It may, for example, be considered that the passive circuit 5, carrying its two fuses 19*a* and 19*b* and having a frequency $Fr_1$, corresponds to an anti-tank mine, and the passive circuit, in which the fuse 19*a* has melted, corresponds to an anti-personnel mine.

The simulation device used in this case is close to that described with reference to FIG. 7. It differs only in that the memory outputs 22*a*, 22*b* after relays 26*a* and 26*b* are not compared to the timer signal (the comparator 25 and the inclusive-OR gate 27 are eliminated). In fact, the "type of mine" information (supplied, for example, by memories 22*a* and 22*b*) is used to control the signalling means 16, 18. These means can be different for each type of mine. An "anti-tank mine" causing, for example, the stoppage of the vehicle and an "anti-personnel mine" causing a simple auditory signal. As in the above, the control means can transmit the coordinates of the vehicle and the characteristics of the mine encountered.

Such an embodiment is particularly advantageous since it enables different types of mines to be simulated using a single passive circuit model.

In the embodiments described with reference to FIGS. 6 and 7, after the detection of a mine whose active-life time has not run out, provision will be made for a power signal to be sent by the generator 13. The signal strong enough so that the current induced in the passive circuit 5 is able to melt the fuse 19. When the circuit 5 comprises several fuses not having been destroyed, the duration of the signal will be long enough to ensure the destruction of all the fuses and the inactivation of the passive circuit.

Figure 8:
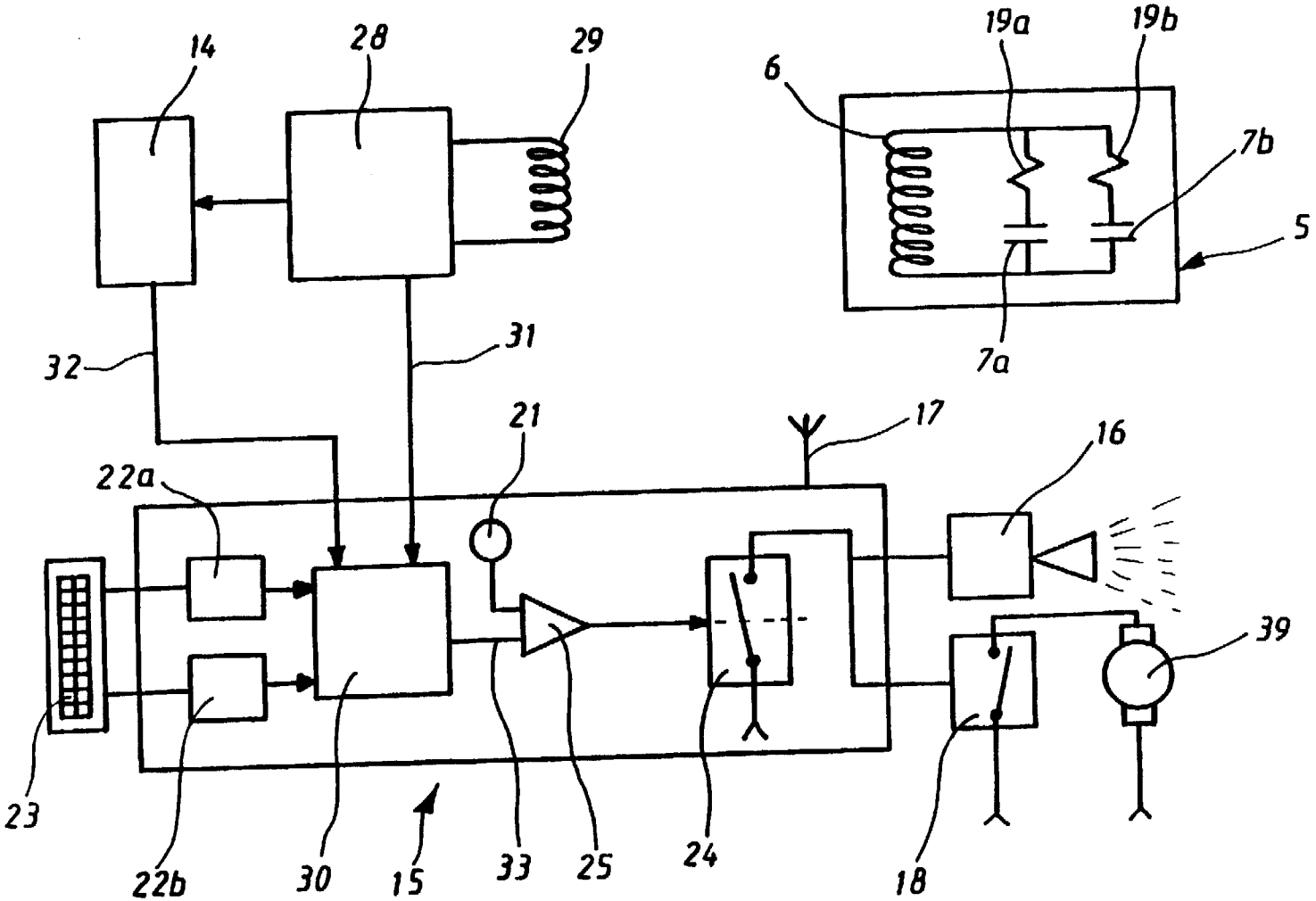
FIG. 8 is a schematic electrical diagram of the simulation device according to a fourth embodiment of the invention.

FIG. 8 shows a simplified electric diagram of the simulation device according to a fourth embodiment of the invention.

Once again, this device is shown associated with a passive circuit 5 comprising at least two capacitance/fuse arms positioned in parallel to the terminals of the inductive resistor 6.

The active circuit differs from the active circuits described previously in that the detection means comprise a wobbled frequency generator 28 connected to an emitting coil 29. Wobbled frequency generators are well known to one having ordinary skill in the art. They supply a signal whose frequency varies periodically between two fixed limits.

Such generators are commonly used in electronics, for example, to adjust the circuits connected to radio or television receivers.

As before, the generator is connected to a fluctuation detector 14, the latter being connected to the control means 15.

The control means comprises a computer 30 which receives the signal from the fluctuation detector (via connection 32) as well as the signal supplied by the generator (via connection 31).

The computer thus determines the frequency value F emitted by the generator 28 for which a coupling with the passive circuit 5 has been detected.

It is also connected to two memories or recorders 22*a*, 22*b* which both contain a number representative of a theoretical active-life time for the exercise mine used. By programming the computer 30, a given frequency of the generator 28 is associated with each memory. The computer is also programmed so as to supply the contents of the memory corresponding to the detected frequency at its output 33. This number is compared at comparator 25 with the timer 21 signal. When the "active-life" of the detected mine has run out, the circuit breaking means 24 are activated so as to prevent the activation of the signalling means (16, 18).

The 24 the circuit breaking means for example, will normally be open and its closure will be controlled by the comparator 25 if the active-life time of the mine has not run out.

It is, of course, possible to detect two types of passive circuits using this embodiment of the invention.

It is also possible for the different active-life times not to be provided and to replace the comparator 25 and the relay 24 by a means to control signalling adapted to the type of mine detected (anti-tank or anti-personnel).

It is also advantageous to generate a power signal enabling the passive circuit detected to be inactivated.

The advantage of such an alternative is that it enables the simulation device to be adapted to numerous different passive circuits by using a single generator 28.

However, when the simulation device must be implemented by a fast vehicle (speed exceeding 30 km/hour) the alternative embodiment comprising several generators simultaneously emitting their signals will be preferred (FIG. 7).

Figure 9:
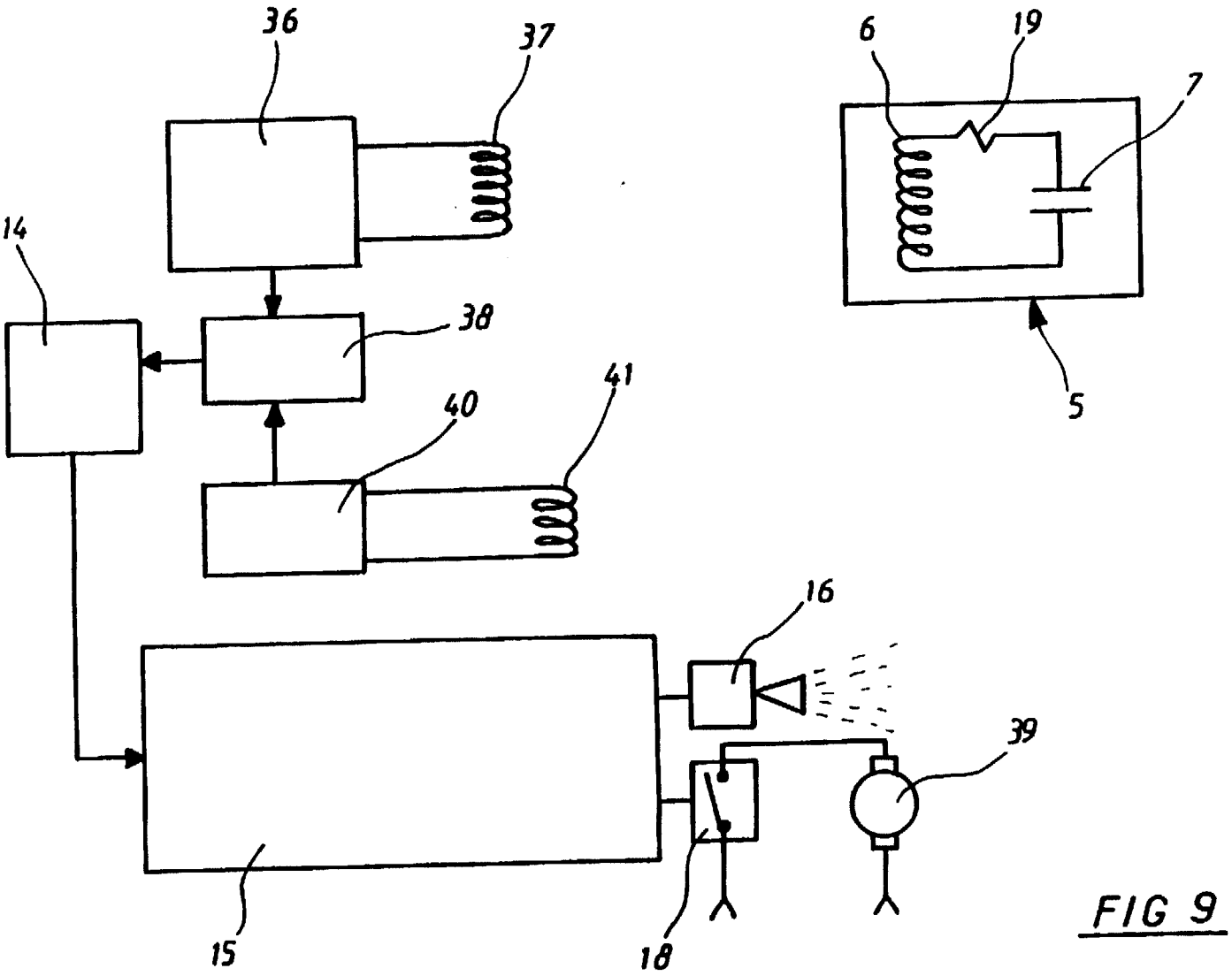
FIG. 9 is a schematic electrical diagram of the simulation device according to a fifth embodiment of the invention.

FIG. 9 shows a simulation device according to a fifth embodiment of the invention.

This embodiment differs from the previous ones in that the detection means comprises, firstly, a generator 36 containing an active oscillating circuit and connected to an emitter coil 37 and, secondly, a receiver coil 41 connected to a receiver amplifier circuit 40.

A band filter 38 receives the signals emitted by the generator 36 and those received and amplified by the circuit 40. It isolates, from the signal received by the coil 41, the frequency lines due to the magnetic field emitted by the coil 37. This is provided in order to avoid disturbances due to external fields.

The band filter can, for example, be a synchronous filter, the principle of which is well known to one having ordinary skill in the art.

The filter is connected to a fluctuation detector 14 which is connected to a control means 15 which can be made in any one of the previously described forms.

The device operates as follows.

When the device comes into the vicinity of an exercise mine according to the invention carrying a passive circuit 5, the field emitted by the coil 37 generates a current in the passive circuit 5.

This current causes a modification to the magnetic field in the vicinity of the passive circuit. This modification in turn leads to a fluctuation of the amplitude of the electric potential at the terminals of the receiver coil 41. This fluctuation is detected by the detector 14 which causes the mine to be counted by the control means 15 and the possible activation of signalling means 16, 18.

The advantage of such an alternative embodiment of the invention lies in its capacity to separate the "generation of a magnetic field" function from the "detection of a disturbance in the field" function. Different inductive resistance values can, therefore, be selected for the coils 37 and 41, values which are well adapted to the function of each coil.

It is therefore much easier to detect unbalances in the magnetic field caused by the passive circuits because the sensitivity of the detector is improved.

A further advantage of this alternative is that the emitter coil and the receiver coil can be positioned in different places.

Thus, to deploy the simulation device on a vehicle, the two coils will advantageously be placed under the vehicle towards the front, each coil being positioned at a different side of the vehicle.

The emitter coil 37 can, thus, be positioned in the vicinity of the right front wheel (or right track) and the receiver coil 41 can be positioned in the vicinity of the left front wheel (or left track).

The emitter coil can also be placed to the front of the vehicle with the receiver coil being placed to the rear.

In any event, the coils will preferably be adjusted so that the emitter coil 37 emits its magnetic field towards the ground under the vehicle, the receiver coil 41 being adjusted so as to receive the maximum magnetic flux from the ground.

Such an arrangement favors the detection of exercise mines located under the vehicle and therefore mines which, from an operational point of view, are placed such that they would normally be initiated by the vehicle.

By suitably adjusting the sensitivity, it is therefore possible to limit detection to those mines which effectively lie under the vehicle and avoid detection of those mines which are on either side of it. The device according to the invention thus provides realistic simulation which is even closer to operational use.

It is, of course, possible to combine this embodiment with the other embodiments described above.

Notably, several emitter 36/receiver 40 couples can be provided with each being associated with a different detection frequency. This in order to differentiate between mines of different types or active-life times (combination of this embodiment with that in FIG. 7).

In place of the generator 36, a wobbled frequency generator can be provided (combination of this embodiment with that in FIG. 8).

Figure 10:
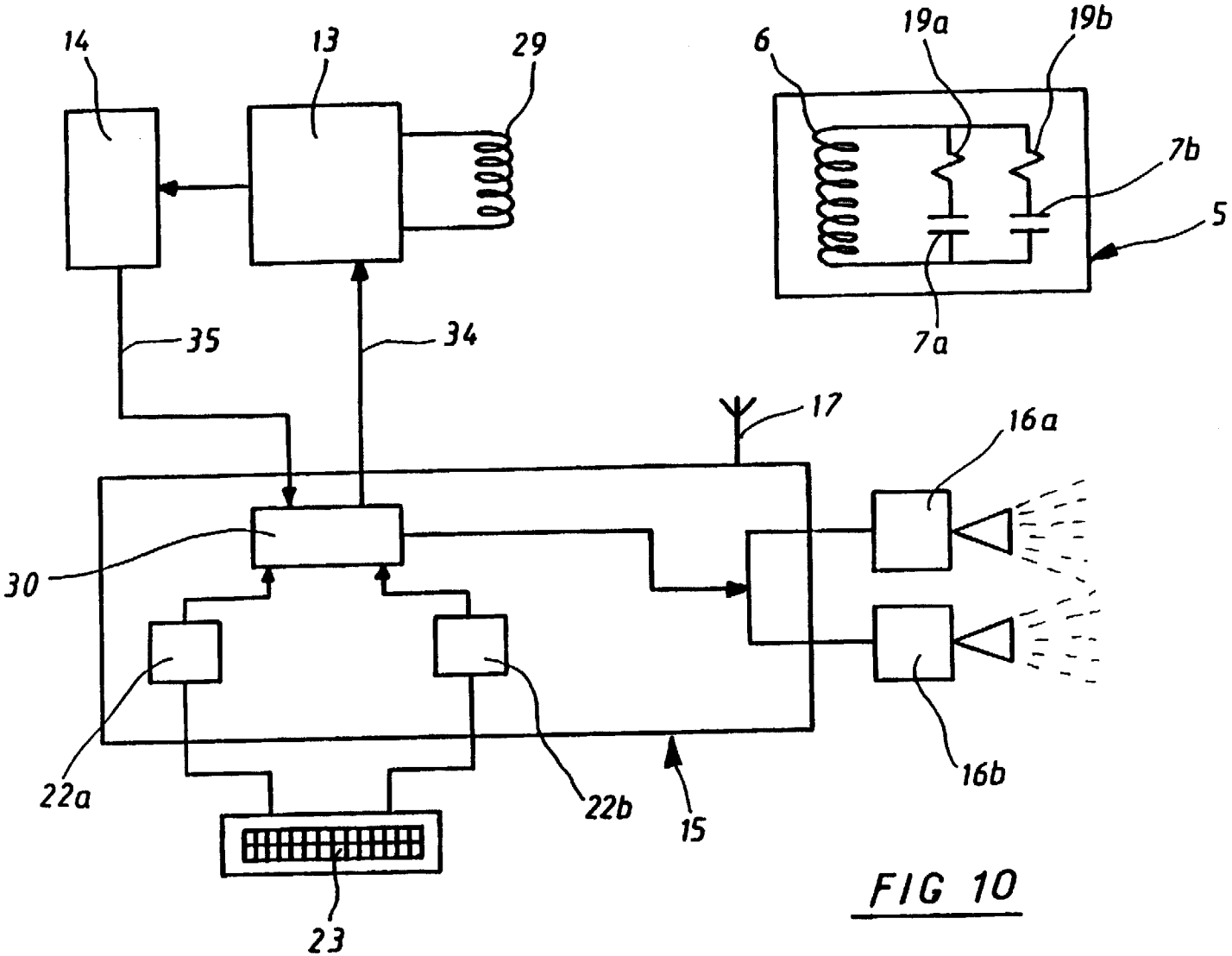
FIG. 10 is a schematic electrical diagram of the simulation device for a demining operation.

The invention also relates to a simulation device for a demining vehicle. Such a device is described with reference to FIG. 10.

This simulation device is implemented with exercise mines according to the invention, that is to say mines having a passive oscillating circuit comprising one or more capacitances (*7a*, *7b*).

It comprises a generator 13 coupled with an emitter coil 29. The frequency of the generator can, advantageously, be adjusted by control means 15 (via connection 34). The generator is, once again, connected to a fluctuation detector 14 whose output signal is applied to a computer 30 in the control means 15. The memories or recorders 22*a*, 22*b* each receive a number representative of a theoretical active-life time of the exercise mine used.

The computer checks whether a mine is still active and, if required, activates the signalling means 16*a*, 16*b* when the mine is "active".

The strength of the signal emitted by the generator will be enough to melt the fuse or fuses carried by the passive circuit. In practice, although the signal is permanently strong enough to deactivate the passive circuits, approaching such a circuit will cause a disturbance of the emitted signal which is enough to ensure detection and enable the emission of a signal (for example, auditive) indicating the destruction of a mine.

In a similar way to the embodiment described with reference to FIG. 7, several generators, each having different emission frequencies, can be provided. This allows recognition of several mines of different types.

We claim:

1. An exercise mine system for training in mine detection, comprising:

at least one passive oscillating circuit tuned to a given frequency and carried by a mine;

at least one active oscillating circuit carried by a target of opportunity; and at least one fluctuation detector to detect fluctuations in said at least one active oscillating circuit as said at least one active oscillating circuit comes within a predetermined distance of said at least one passive oscillating circuit, wherein the at least one passive oscillating circuit includes at least one fuse or destructible part, and wherein a signal generated by said at least one active oscillating circuit is of a strength to trigger said at least one fuse or destructible part.

2. An exercise mine system for training in mine detection according to claim 1, wherein said at least one active oscillating circuit generates a signal at an adjustable frequency and strength; and an active circuit that enables the determination of the given frequency of the at least one passive oscillating circuit carried by the mine and includes a switch controlling the generation of a power signal at the given frequency, wherein the power signal is designed to trigger the fuse or destructible part of the at least one passive oscillating circuit on the mine.

3. An exercise mine system for training in mine detection according to claim 1, wherein said at least one passive oscillating circuit is made of a rigid printed circuit attached to the mine.

4. An exercise mine system for training in mine detection according to claim 1, wherein said at least one passive oscillating circuit is made of a flexible printed circuit attached to the mine.

5. An exercise mine system for training in mine detection according to claim 1, wherein said at least one passive oscillating circuit is made of a serigraph of conductive paint.

6. An exercise mine system for training in mine detection according to claim 5, wherein the serigraph is carried on a label affixed to the mine.

7. An exercise mine system for training in mine detection according to claim 1, further comprising signalling means connected to said at least one fluctuation detector for signalling when said at least one active oscillating circuit comes within said predetermined distance of said at least one passive oscillating circuit.

8. An exercise mine system for training in mine detection according to claim 7, wherein each oscillating circuit of said at least one active oscillating circuit includes a coil attached to a front part of a vehicle and said each active oscillating circuit is insulated from the vehicle by a screen of material having high magnetic permeability and high specific resistance.

9. An exercise mine system for training in mine detection according to claim 8, wherein the at least one active oscillating circuit is carried on a vehicle and said signaling means further comprises circuit breaking means positioned in a power supply circuit of the vehicle whereby the at least one fluctuation detector activates the circuit breaking means to make the vehicle stop.

10. An exercise mine system for training in mine detection according to claim 7, further comprising:

a timer;

at least one memory adapted to receive at least a number representative of an active-life time of at least one passive oscillating circuit; and a monitor device to prevent activation of said signalling means by the at least one fluctuation detector when the active-life time of said at least one passive oscillating circuit is exhausted as measured by said timer, whereby an exercise mine can have an active life assigned thereto.

11. An exercise mine system for training in mine detection according to claim 7, wherein said at least one passive oscillating circuit comprises at least one inductive resistor whose terminals are connected to at least two circuit arms, each arm being formed of a capacitance and a fuse or destructible part connected in series, and tuned to a given frequency, whereby said at least one passive oscillating circuit can present itself as two passive oscillating circuits and be used to represent more than one type of mine.

12. An exercise mine system for training in mine detection according to claim 11, wherein said at least one active oscillating circuit is at least two active oscillating circuits, each active oscillating circuit being tuned to a different frequency to enable detection and differentiation of either different mines having different passive oscillating circuits or said at least two circuit arms of one passive oscillating circuit carried on one mine.

13. An exercise mine system for training in mine detection of claim 12, further comprising a fluctuation detector for each active oscillating circuit.

14. An exercise mine system for training in mine detection of claim 11, further comprising:

at least one timer;

at least one memory adapted to receive at least a number representative of an active-life time of said at least one passive oscillating circuit; and a monitor device including means to determine the given frequency of a detected passive oscillating circuit or a given circuit arm of a detected passive oscillating circuit and to associate this frequency to one of the active-life times stored in said at least one memory, whereby said monitor device can determine the active life of either different passive oscillating circuits carried by different mines or the at least two circuit arms of one passive oscillating circuit carried by one mine.

15. An exercise mine system for training in mine detection according to claim 1, wherein the mine is made of an environmentally degradable substance.

16. An exercise mine system for training in mine detection and to simulate the action of at least one mine, said system comprising:

means to detect at least one passive oscillating circuit carried by an exercise mine;

a fuse in the at least one passive oscillating circuit; and at least one active oscillating circuit means for detecting the at least one passive oscillating circuit, wherein a signal generated by said at least one active oscillating circuit means is of a strength to trigger said fuse.

17. An exercise mine system for training in mine detection of claim 16, wherein said detection means includes at least one receiver coil connected to an amplifying means and a band filter.

18. An exercise mine system for training in mine detection of claim 16, wherein the at least one active oscillating circuit means includes at least two active oscillating circuits, each circuit adapted to be tuned to a different self-resonant frequency to enable the detection and differentiation of at least two passive oscillating circuits identifying different type exercise mines.

19. An exercise mine system for training in mine detection of claim 16, wherein the at least one active oscillating circuit means is adapted to deliver a signal at a wobbled frequency in a given frequency band to enable detection of at least two passive oscillating circuits identifying at least two different types of exercise mines.

20. An exercise mine system for training in mine detection of claim 16, wherein the at least one active oscillating circuit means comprises an active oscillating circuit and the means to detect comprises a receiver and a filter, the filter connected to a fluctuation detector, said fluctuation detector having a sensitivity threshold established to detect said active oscillating circuit at a given distance from the at least one passive oscillating circuit integral with a mine.

21. An exercise mine system for training in mine detection of claim 20, wherein the fluctuation detector controls signalling means for signalling that said at least one active oscillating circuit is within said given distance of said at least one passive oscillating circuit.

22. An exercise mine system for training in mine detection of claim 20, wherein each passive oscillating circuit of the at least one passive oscillating circuit has a fuse therein, the fluctuation detector controls the emission of a power signal by the active oscillating circuit, and said power signal is adapted to trigger the fuse of one of the at least one passive oscillating circuits carried by the mine.

23. A device to simulate a demining operation, comprising:

a remote signal generator for emitting a signal at a predetermined frequency;

a passive oscillating circuit carried by an exercise mine, said passive oscillating circuit having at least one fuse; and wherein said remote signal emitted by said signal generator is of a strength to melt at least one of the at least one fuse to render the passive oscillating circuit inactive.

* * * * *